United States Patent [19]

Heger

[11] Patent Number: 5,054,949

[45] Date of Patent: Oct. 8, 1991

[54] CAP FOR WRITING IMPLEMENT WITH AIR VENT

[75] Inventor: Friedrich Heger, Feucht, Fed. Rep. of Germany

[73] Assignee: J.S. Staedtler GmbH & Co.

[21] Appl. No.: 459,774

[22] PCT Filed: May 25, 1989

[86] PCT No.: PCT/DE89/00329

§ 371 Date: Jan. 26, 1990

§ 102(e) Date: Jan. 26, 1990

[87] PCT Pub. No.: WO89/11978

PCT Pub. Date: Dec. 14, 1989

[30] Foreign Application Priority Data

May 31, 1988 [DE] Fed. Rep. of Germany ..... 3818473

[51] Int. Cl.[5] ..... B43K 9/00

[52] U.S. Cl. ..... 401/202; 401/213; 401/243

[58] Field of Search ..... 401/202, 213, 243

[56] References Cited

U.S. PATENT DOCUMENTS 4,844,642 7/1989 Inaba et al. ..... 401/202 X

FOREIGN PATENT DOCUMENTS 0204252 12/1986 European Pat. Off. .
2138694 2/1973 Fed. Rep. of Germany ..... 401/202
3728896 6/1988 Fed. Rep. of Germany .
6111016 6/1983 Japan .
33364 10/1921 Norway .
339628 12/1930 United Kingdom .
2174374 11/1986 United Kingdom .

*Primary Examiner*—Steven A. Bratlie
*Attorney, Agent, or Firm*—Toren, McGeady & Associates

[57] ABSTRACT

In a writing implement cap, especially for ball point pens, having at least one air channel penetrating the front face, an air channel is shaped so as to extend axially and radially and is located in the region of the otherwise closed front side. Apart from that the axially extending segments of the air channel are bounded by at least one baffle wall extending transversely or by at least one step or disk and are connected through at least one radial aperture with additional axial segments arranged to be offset or with the inside space of the cap so as to form continuous through air channels.

Over and above that the cap wall, the end wall and the baffle wall or the step or the steps or the disk or the disks are to be designed so as to form one piece with each other.

6 Claims, 3 Drawing Sheets

CAP FOR WRITING IMPLEMENT WITH AIR VENT

BACKGROUND OF THE INVENTION

The invention is directed to a cap for writing implements, especially for ball point pens, however also for other writing-, drawing, or painting appliances, wherein the cap comprises at least one air channel penetrating the front end.

Such caps are known from the EP-OS 204 252 (A1). These known caps however always consist of several inserted parts and/or parts which are axially movable against each other and are therefore always costly and usually involve complicated fabrication.

Additionally, these known caps do not assure a reliable, always present air circulation, when the cap is separated from the writing-, drawing- or the painting implement. The air channel in the end wall can and is to be sealed especially by the axially mobile inner seal.

SUMMARY OF THE INVENTION

Therefore, it is the task of the present invention to create a simple and economically fabricatable cap for writing implements of all types, which reliably protects against soiling one's clothes, as well as protecting against damage to the writing tip and which in spite of that provides continuous air circulation, if it is not connected with the writing implement.

Pursuant to this task, one aspect of the present invention resides in providing an air channel exclusively in the region of the otherwise closed end of the cap. The air channel being bounded by a baffle wall formed by a disk and a step as part of the front wall of the cap. Also, the baffle wall, front wall and cap wall are all formed as one piece and rigidly connected together.

BRIEF DESCRIPTION OF THE DRAWINGS

The invention is explained with particularity with the help of the drawings and several represented examples. Herein it is shown on.

DETAILED DESCRIPTION OF THE PREFERRED EMBODIMENTS

Figure 1:
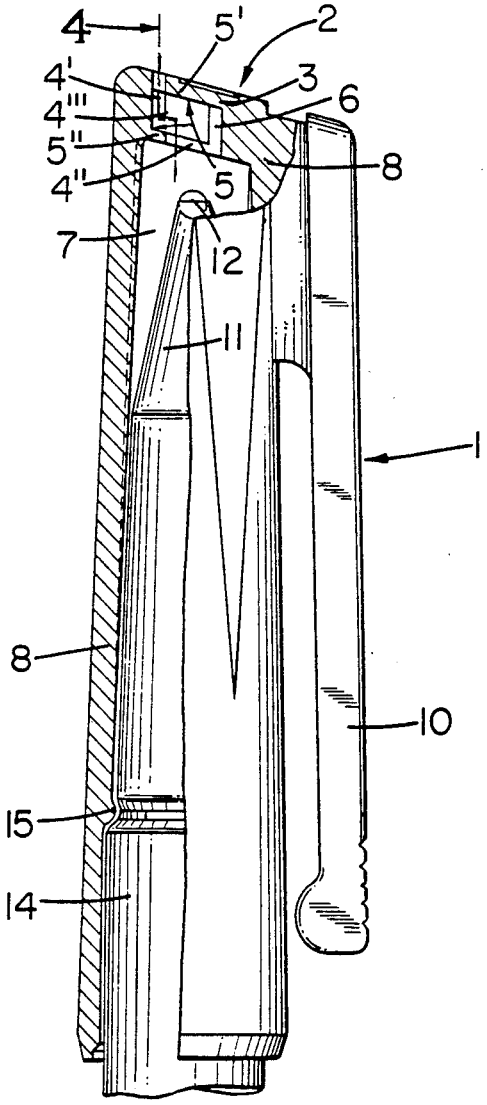
FIG. 1 a first embodiment partially presented in section along the line A—A in FIG. 3, FIG. 2 a side view of the cap in FIG. 1, FIG. 3 a plan view of the cap in FIGS. 1 and 2, FIG. 4 a second embodiment presented in section along the line B—B in FIG. 6, FIG. 5 a side view of the cap in FIG. 4, FIG. 6 a plan view of the cap in FIGS. 4 and 5 and FIG. 7 a third variant with integrated inner seal shown in section.
Figure 2:
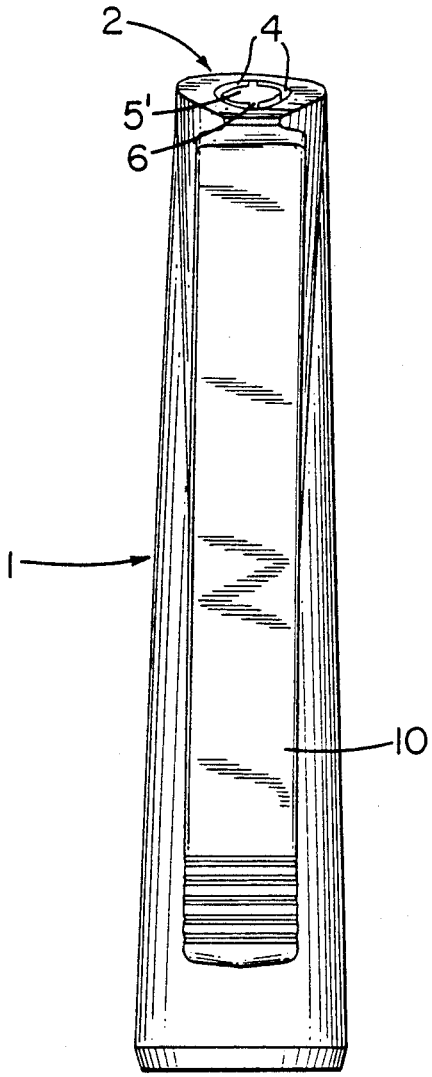
Figure 3:
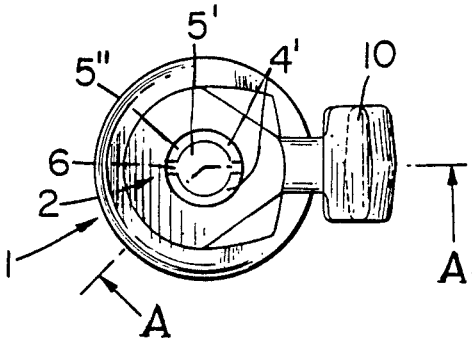

The cap 1 depicted in FIGS. 1 to 3 is designed in one piece and comprises a molded-on clip 10. The closed front face 2 is provided with two semicircular axially extending segments 4' of a continuous air channel 4 penetrating through the front wall 3. Herein simultaneously a disk 5' held by webs 6 is formed by way of a baffle wall 5 effective from the inside. With cooperation of radial apertures 4''' and an additional axial segment 4'', the air channel 4 becomes a through channel and discharges into the inside space 7 of the cap 1.

An annularly shaped cirumferential step 5'', serving as a transversely extending baffle wall 5, causes a redirection of the air flow as well as secure protection of the writing tip 11, which in this case contains a writing ball

12, from damage by foreign bodies axially penetrating into the cap 1.

Apart from that, the step 5' prevents for instance tissue particles of pieces of clothes from penetrating far into the cap and thus establish contact with and foul the writing tip 11 or the writing ball 12.

The shaft 14 of the writing implement and the cap 4 are connected with each other by an annular bead 15 molded to the cap wall 8 in a positively locking or frictionally locking fixed manner, but so as to be axially detachable.

The essentially axially and radially offset axial segments 4' and 4'' of the air channel 4 and the axially adjacent steps 5'' and/or disks 5' serving as baffle walls 5 are in an expedient way shaped so, that they essentially have respectively an identical or nearly identical cross-section.

This facilitates or enables to removal of the caps from the mold in an axial direction; these caps are as a rule manufactured from thermoplastic plastics material using the injection molding process. In order to fasten or secure the disks 5' serving as baffle walls 5, the disks 5' are connected with the front wall 3 and/or the cap wall 8 by radially or possibly also axially extending webs 6.

Figure 4:
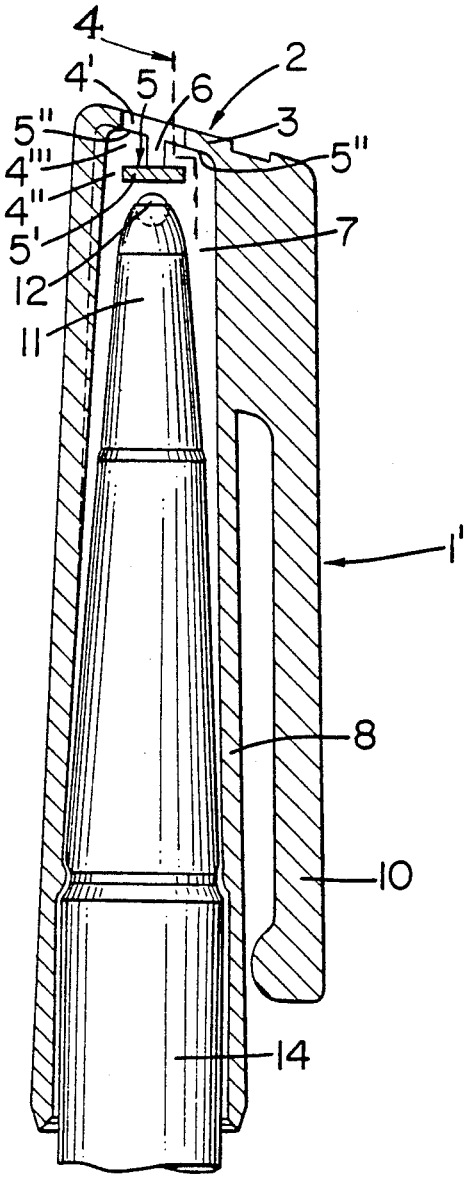
Figure 5:
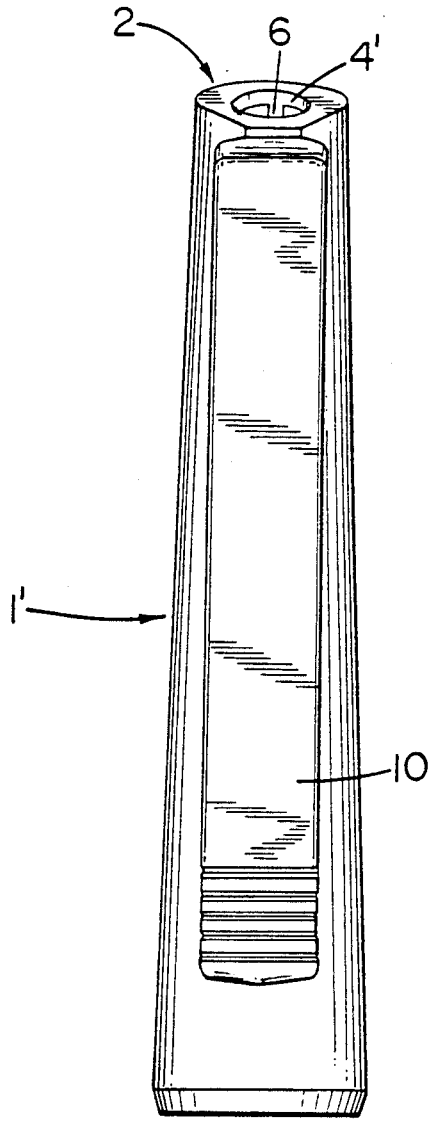
Figure 6:
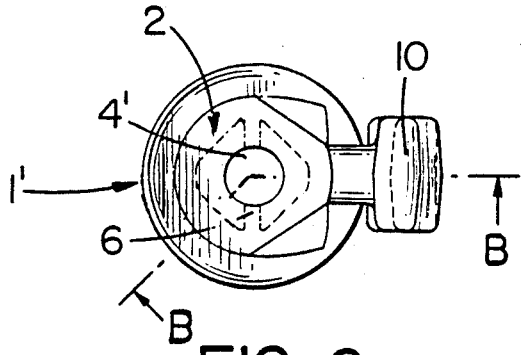

In the embodiment shown in FIGS. 4 to 6, a first axially extending segment 4' of an air channel 4 arranged coaxially to the inside space 7 of the cap 1' penetrates from the front side 2 of the front wall 3.

A continuous through air channel is formed by radial apertures 4''' and additional axial segments 4''. The cap 1', comprising a clip 10, is placed upon the shaft 14 of a writing implement also provided with a writing ball 12.

A round disk 5' shaped as a baffle wall 5 serves herein as a cover of the writing tip 11. This round disk 5' has practically the same cross-section or the same diameter as the axially adjacent segment 4' of the air channel 4, and the disk 5' is rigidly connected by means of webs 6 therewith or molded to the cap wall 8 or the front wall 3 so as to form one piece with. The quantity of the webs can be selected in a random fashion. Expedient and sufficient are, for instance, two, three or four webs.

Figure 7:
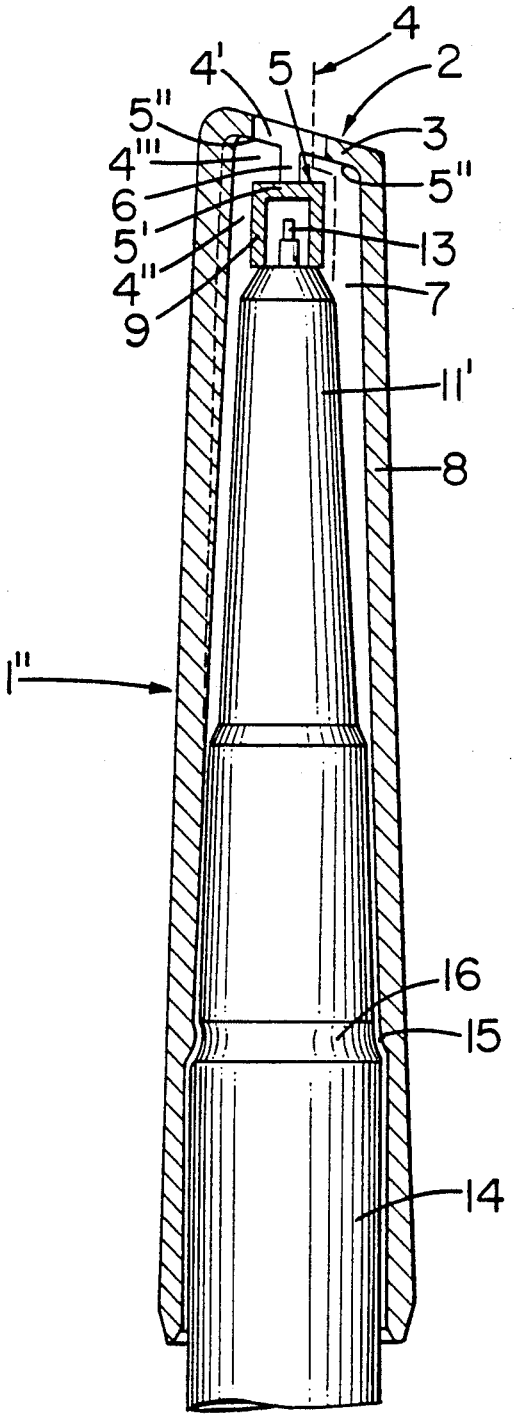

In FIG. 7 the cap 1'', which is basically the same as that shown and described in FIGS. 4 to 6, is assigned to a writing-, drawing- or painting appliance with a tip as a wick 13 and is provided with an additional seal 9. In this way, the tip of the wick 13 and air apertures possibly existing in the region of the writing tip 11'' are sealed in a airtight manner in the closed position, meaning in an installation position slid upon the pen body 14 and retained in a positively locking manner by the annular bead 15.

On the other hand, however, outside air can enter into the inside space 7 through the segments 4', 4''' and 4'' with the cap 1'' removed or also already during the removal of the cap. The seal 9 is made to be pot-shaped and possibly molded to the baffle wall 5 or to the disk 5' retained by the webs 6 so as to form one piece therewith. Alternately, however, any other seal form or type can be selected. Thus, for instance, a foam- or cellular rubber cushion or a silicon application or insertion can be envisaged as the seal 9.

Especially in this embodiment in FIG. 7 there results, apart from the task-defined effect, the additional advantage that with caps having sealing action and similar closure implements there occurs no compression on the one hand and no vacuum formation on the other hand, when the cap is placed upon the writing-, drawing- or painting implement as well as when it is removed from same and that the security against leakage is additionally improved in writing implements of this type.

The possibility of an air circulation through the cap 1, 1', 1'' axially from inside and from outside when said cap is not connected with a writing-, drawing- or painting instrument is intended to serve especially the safety of children or other persons, in order to reduce the danger of suffocation if such a cap is possibly swallowed.

Under this aspect special attention is directed to the circumstance that the cross-section of the air channel 4 or of its smallest segment 4', 4'', 4''' amounts to at least 5 to 15 $mm^2$, preferably 7 to 10 $mm^2$, so that sufficient air can always flow through.

The secure connection between the pen body 14 and the cap 1'' is achieved in this embodiment by means of an annular groove 16 in the pen body 14 and an annular bead 15 at the cap 1''.

Apart from protecting the writing tip 11, 11', the sunk or recessed location of the disk 5' also provides for the possibility of a protective arrangement of a product-, firm-or other designation, this in an advantageous manner. With such an arrangement blurring or damage to a designation placed in the recessed location is practically impossible.

I claim:

1. A cap for writing implements, especially ball point pens, with at least one air channel penetrating through a front end thereof, the air channel (4) being shaped to extend axially and radially and being located exclusively in the region of the otherwise closed front end (2), the air channel (4) having axially extending segments (4') which are bounded by at least one baffle wall (5) extending transversely to the longitudinal axis and are one of connected by at least one radial aperture (4''') with the inside space (7) of the cap (1, 1', 1''), and arranged to be offset with additional axial segments (4''), to form at least one continuous through air channel (4), the at least one baffle wall (5) being formed by a disk (5') and a step (5'') as a part of a cap front wall, the cap wall (8), the front wall (3) and the baffle wall (5) in one piece and rigidly connected together.

2. A cap according to claim 1, wherein the disk (5') and step (5'') axially bound a respectively adjacent segment (4', 4'') of the air channel (4), the disk (5') and step (5'') having a cross-section essentially equal to that of the air channel (4).

3. A cap according to claim 1, wherein the disk (5') is rigidly connected by webs (6) with the front wall (3) and the cap wall (8).

4. A cap according to claim 1, wherein a seal (9) is assigned to the disk (5').

5. A cap according to claim 1, wherein the air channel (4) has a cross-section of 5 to 15 $mm^2$.

6. A cap according to claim 5, wherein the air channel cross-section is 7 to 10 $mm^2$.

* * * * *